US008161781B2

(12) United States Patent
Gokcebay

(10) Patent No.: US 8,161,781 B2
(45) Date of Patent: Apr. 24, 2012

(54) ELECTRONIC LOCKER LOCK

(75) Inventor: Asil T. Gokcebay, Petaluma, CA (US)

(73) Assignee: Security People, Inc., Petaluma, CA (US)

( * ) Notice: Subject to any disclaimer, the term of this patent is extended or adjusted under 35 U.S.C. 154(b) by 618 days.

(21) Appl. No.: 12/214,364

(22) Filed: Jun. 17, 2008

(65) Prior Publication Data

US 2009/0308115 A1 Dec. 17, 2009

(51) Int. Cl.
*E05B 49/00* (2006.01)

(52) U.S. Cl. ..... 70/278.1; 70/283.1; 70/277; 70/279.1; 340/5.2

(58) Field of Classification Search ..... 70/266, 70/271, 277, 283.1, 278.1–278.4, 279.1, 70/432; 340/5.2
See application file for complete search history.

(56) References Cited

U.S. PATENT DOCUMENTS

| | | | | |
|---|---|---|---|---|
| 2,046,630 | A | | 7/1936 | Jacobi |
| 3,455,127 | A | | 7/1969 | Simon |
| 3,753,164 | A | | 8/1973 | De Vries |
| 3,754,164 | A | | 8/1973 | Zorzy |
| 3,754,213 | A | | 8/1973 | Morroni et al. |
| 3,831,065 | A | | 8/1974 | Martin et al. |
| 3,878,571 | A | | 4/1975 | Seeley |
| 4,243,256 | A | | 1/1981 | Frydrych |
| 4,495,540 | A | | 1/1985 | Remington et al. |
| 4,568,998 | A | | 2/1986 | Kristy |
| 4,665,397 | A | | 5/1987 | Pinnow |
| 4,887,445 | A | | 12/1989 | Beatty |
| 4,931,789 | A | | 6/1990 | Pinnow |
| 4,956,984 | A | * | 9/1990 | Chi-Cheng ..... 70/277 |
| 4,967,305 | A | | 10/1990 | Murrer et al. |
| 5,020,345 | A | | 6/1991 | Gartner et al. |
| 5,021,776 | A | | 6/1991 | Anderson et al. |
| 5,033,282 | A | | 7/1991 | Gartner et al. |
| 5,153,561 | A | | 10/1992 | Johnson |
| 5,223,829 | A | | 6/1993 | Watabe |
| 5,321,963 | A | | 6/1994 | Goldman |
| 5,373,718 | A | | 12/1994 | Schwerdt et al. |
| 5,461,218 | A | | 10/1995 | Castleman et al. |
| 5,564,294 | A | | 10/1996 | Chen |
| 5,845,523 | A | | 12/1998 | Butterweck et al. |
| 5,886,644 | A | | 3/1999 | Keskin et al. |
| 5,894,277 | A | | 4/1999 | Keskin et al. |
| 6,116,066 | A | | 9/2000 | Gartner et al. |
| 6,331,812 | B1 | | 12/2001 | Dawalibi |
| 6,347,486 | B1 | | 2/2002 | Badillet |
| 6,791,450 | B2 | | 9/2004 | Gokcebay et al. |
| 6,989,732 | B2 | | 1/2006 | Fisher |
| 7,336,150 | B2 | | 2/2008 | Gokcebay |
| 7,469,564 | B1 | * | 12/2008 | Shaw ..... 70/283 |
| 7,516,633 | B1 | * | 4/2009 | Chang ..... 70/472 |
| 2003/0024288 | A1 | | 2/2003 | Gokcebay et al. |
| 2006/0076385 | A1 | | 4/2006 | Etter et al. |
| 2006/0150694 | A1 | * | 7/2006 | Frolov et al. ..... 70/277 |
| 2007/0056339 | A1 | | 3/2007 | Irgens et al. |
| 2007/0090921 | A1 | | 4/2007 | Fisher |
| 2007/0169525 | A1 | * | 7/2007 | Chang ..... 70/472 |
| 2007/0277571 | A1 | | 12/2007 | Gokcebay |
| 2009/0249846 | A1 | * | 10/2009 | Gokcebay ..... 70/279.1 |
| 2010/0139338 | A1 | * | 6/2010 | Wintersteiger ..... 70/78 |

* cited by examiner

*Primary Examiner* — Suzanne Barrett
(74) *Attorney, Agent, or Firm* — Thomas M. Freiburger

(57) ABSTRACT

A locker lock fits a standard locker door three-hole door prep, with all electronics contained in a single housing mounted on the front of the locker door and a latch device behind the locker door. The locker lock preferably includes a keypad to allow rotation of a handle or knob, and also includes a manager's override and power jump terminal.

28 Claims, 5 Drawing Sheets

ELECTRONIC LOCKER LOCK

BACKGROUND OF THE INVENTION

This invention is concerned with security of lockers, safes, desks, file cabinets or other storage devices assigned for temporary or long-term use, especially lockers. In particular, the invention relates to an electronic lock for a locker having a standard three-hole locker door prep layout, to replace a standard key or combination lock fitting the same locker door. The lock of the invention is compact, manually operated (although embodiments could be automatically operated) to release a locker door latch when the electronic access control is properly accessed.

Electronic locks are well known. For example, hotel safes for temporary use by guests have included digital locks with keypads for use by the guest. In some cases, the guest was able to select his own combination for the digital lock. In other cases, a combination sequence has been pre-assigned to electronic locks, with the combination sequence not under the control of the user.

U.S. Pat. Nos. 5,886,644 and 5,894,277, owned by the assignee of the present invention, describe electronic locker locks to fit a standard three-hole door prep layout as well as other doors. The electronic locks described in those patents are comprised of two housings, mounted at front and back of the door and electronically connected through the center hole of the three-hole door prep layout, and they included an electromagnetically-driven latch, retracted automatically by the lock device when the proper code was entered by a user, either via a keypad or an electronic ID device such as an iButton. Both patents are incorporated herein by reference.

The following additional U.S. patents are believed to have some relevance to this invention: U.S. Pat. Nos. 5,373,718, 5,321,963, 5,223,829, 5,153,561, 5,033,282, 5,021,776, 5,020,345, 4,967,305, 4,931,789, 4,887,445, 4,665,397, 4,568,998, 4,495,540, 4,243,256, 3,878,511, 3,831,065, 3,754,213, 3,754,164 and 3,753,164.

There has been a need for an electronic lock operated by an electronic identification device of relatively inexpensive construction, particularly for lockers but with more versatility as to use on various standard designs, modularity as to assembly and opposite-hand use, easy programmability and convenience and simplicity to the user. These are the goals of the present invention described below.

SUMMARY OF THE INVENTION

The invention addresses these goals with a low profile and compact electronic unit that, in a preferred application, fits the standard three-hole locker door prep layout of a locker door. The compact electronic locking device fits on the front side of the door and in one embodiment has a knob or handle that can rotate a latch at the back side of the door when such manual rotation is permitted by the lock electronics. The electronic lock comprises a single electronic lock housing which is positioned on the outside of the door; at the back side of the door, i.e. the opposite side of the three-hole door prep, is either a latch driven directly by a driver extending back from the electronic unit, or a mechanical unit with a latch, sometimes known as a built-in lock for lockers, and this unit is driven by the driver extending back from the handle in the electronics housing. It is important that all electronics are contained in a single electronics housing at the front side of the locker door, with mechanical features, e.g. the latch or a built-in deadbolt lock device, behind the door and connected to the driver.

In one preferred embodiment particularly adapted for a locker with a latch, the electronic lock of the invention includes a single compact electronic lock housing with a keypad for entry of codes by a user, the housing adapted to be positioned on the front panel of the locker door having a standard three-hole locker door prep arrangement. The lock driver extends from the back side of the electronics housing and is adapted to engage with and operate a locker latch device on the inside of the locker door, and with a knob or handle on the outside housing for operating the lock manually to rotate the driver and retract the latch device when permitted by the electronics. The latch device may also be operated by an electromagnetic or motorized mechanism in the outside housing, rather than manually. The driver extends through the middle hole of the three-hole lock receiving pattern on the door, with provision for fasteners extending through the upper and lower holes of the three-hole pattern to secure the electronics housing to the door. A battery compartment preferably is included in the housing to operate the electronics and in a preferred embodiment is accessible from the exterior when the housing is secured against a locker door.

The invention thus provides a compact, easily used electronic lock requiring low power in the case where unlatching is done manually, easily fitted to a locker door with standard three-hole pattern and advantageously used to replaced a keyed or combination lock. These and other objects, advantages and features of the invention will be apparent from the following description of a preferred embodiment, considered along with the accompanying drawings.

DESCRIPTION OF PREFERRED EMBODIMENTS

Figure 1:
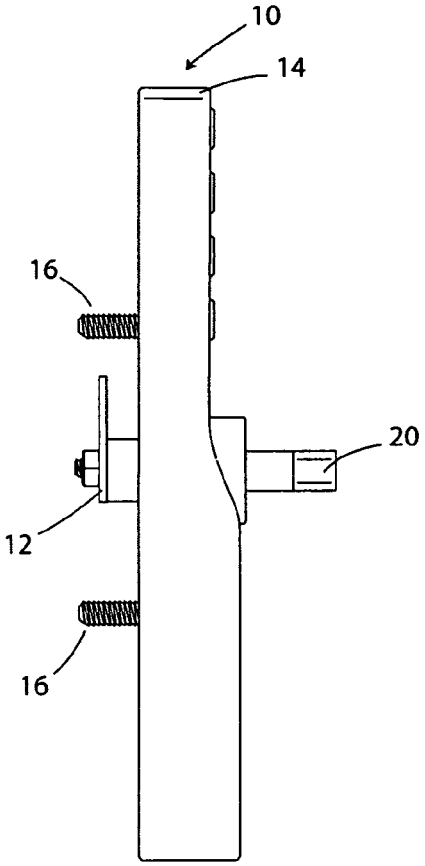
FIGS. 1 and 2 are side and front elevation views showing one embodiment of an electronic lock device, with keypad, adapted particularly for lockers.
Figure 2:
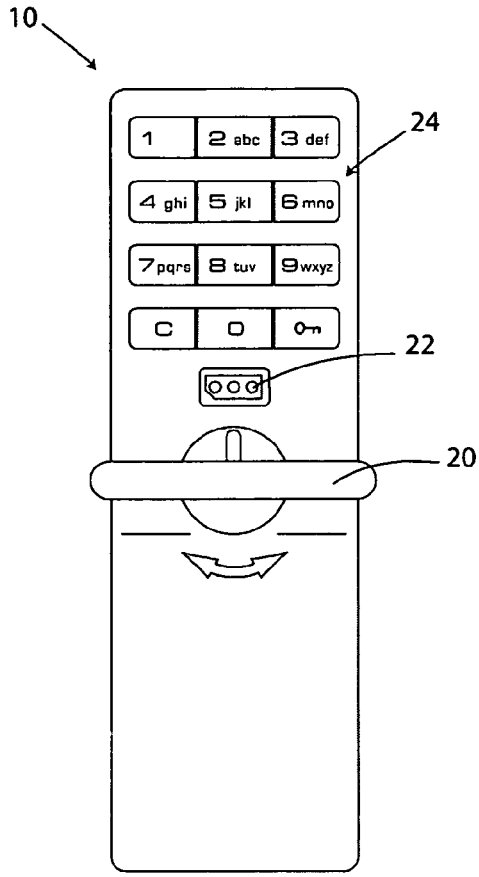

FIG. 1 shows a lock 10 particularly adapted for locker doors having a standard three-hole locker door prep layout. As is well known, the three holes are aligned vertically, with fastener holes at top and bottom and a larger center hole for a key cylinder or a combination lock or an appropriate form of lock with a handle to release a latch. In the case of U.S. Pat. No. 5,886,644 referenced above, the center hole was used for electrical connection between a front housing and a rear housing. In the lock device of FIG. 1 herein the center hole can accommodate a rotating latch 12, which can be attached to the remainder of the lock via a spindle or driver (not shown in FIG. 1, see FIG. 6) after a lock housing 14 is installed on the front side of the door. As indicated, machine screw studs 16 can be provided extending back from the back side 18 of the housing 14, for securing the lock to the door using nuts (or threaded holes can be provided, FIG. 3 below, to receive machine screws through the door). FIGS. 1 and 2 show a manually operated handle 20 of desired form, which can be a lever as shown, at the front of the lock to rotate the latch. The lock 10 has internal electronics, supported by batteries carried in the housing, and functions internally similarly to the lock described copending application Ser. No. 11/809,172, incorporated by reference. Like the lock of the copending application, the lock 10 has a terminal 22, i.e. a set of contacts 22 for engagement by an electronic key device, for both supplying jump power to the lock when its internal batteries are low, and entering a master code to access (unlock) the lock. Such a terminal and manager or master key device are also described in application Ser. No. 12/072,557, filed Feb. 26, 2008 and in U.S. Pat. No. 7,336,150. The disclosures of the application and the issued patent are also incorporated herein by reference. As described in the referenced patent and applications, the manager's key device allows a manager or supervisor to apply the key device to simultaneously jump power to the lock 10 and enter a master code to open the lock.

A keypad 24 preferably is provided on the lock device 10. Other electronic code input devices, such as a contact for an iButton key such as shown in U.S. Pat. No. 7,336,150, could be provided, as discussed below, or proximity or other wireless input or Weigand or mag stripe card readers.

The electronic locker lock 10 of the invention preferably operates in a manner generally similar to that described in the above-referenced U.S. Pat. Nos. 5,886,644 and 5,894,277, both describing locker locks, except that here the locker lock is moved from locked to unlocked position and vice versa by operating the handle 20. As explained in those prior patents, the user of the locker lock, usually for temporary use, approaches the locker in an unlocked condition. The user enters a code, which may be selected by the user in the case of a keypad 24 as shown, after placing his valuables in the locker and closing the door. This has the effect of retracting an internal blocking device which has been engaged against a ridge or in a notch on the rotatable member or driver within the lock. The retraction of the blocking device allows the user to turn the knob or handle to extend a bolt and put the lock in the locked condition. When moved to the locked position, the internal member or driver is retained in this position by the blocking device again engaging with the driver, preferably in a notch dedicated to the locked position. Later, when the user again approaches the locker to retrieve his valuables, the access code is again entered, again causing the blocking device to be retracted and enabling the user to rotate the knob to put the lock in the unlocked condition. Again, the blocking device engages in the unlocking notch. The engagement in the notch can be via a spring, with retraction being only momentary (by a miniature motor or solenoid), or both retraction and engagement of the blocking device can be performed by a solenoid or miniature motor.

Figure 3:
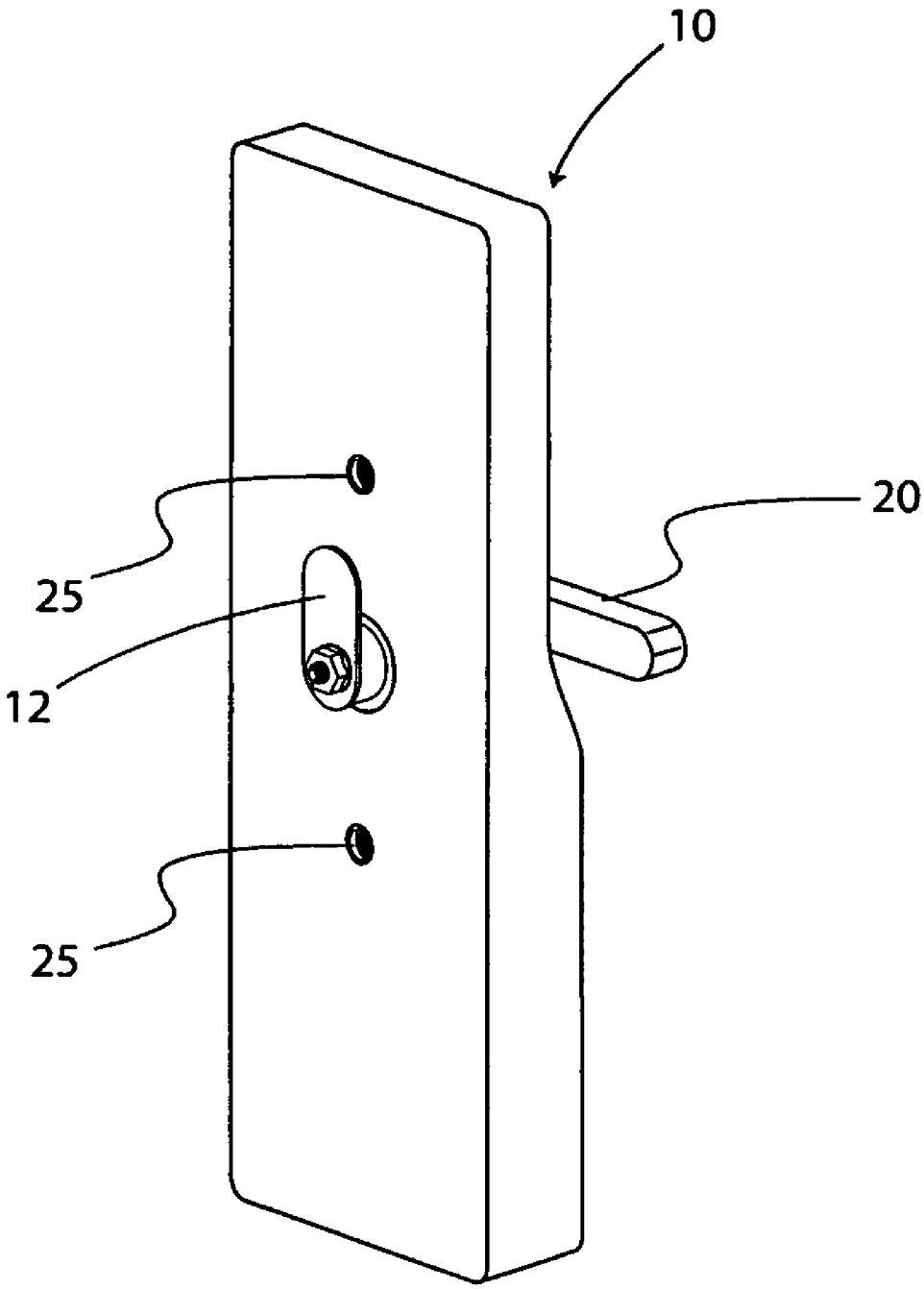
FIG. 3 shows in perspective a variation of FIGS. 1 and 2.

FIG. 3 shows that the locker lock 10 can have threaded holes 25 to receive machine screws inserted from the back of the door, rather than the studs shown in FIG. 1.

Figure 4:
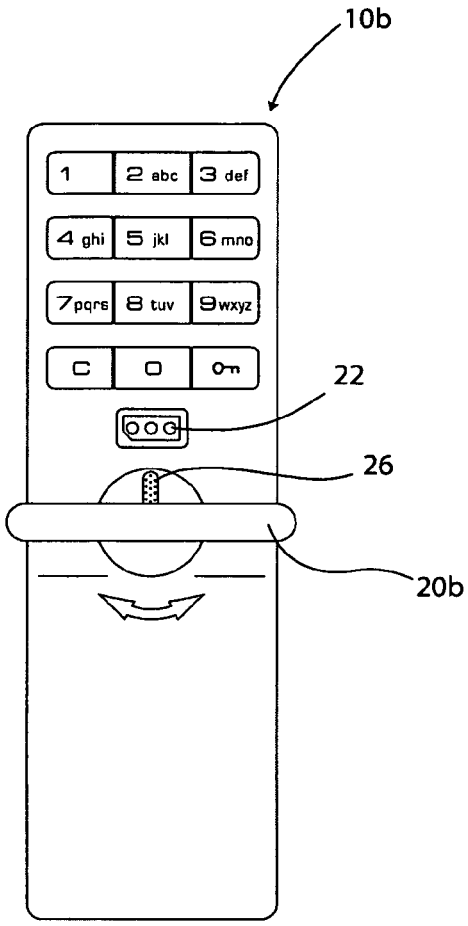
FIGS. 4 and 5 are front elevation views showing another variation of the electronic lock of FIGS. 1 and 2, showing locked and unlocked positions, respectively.
Figure 5:
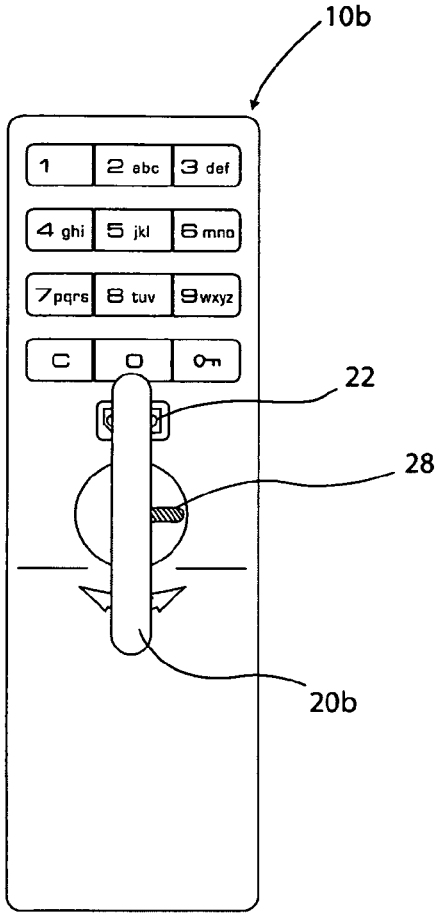

FIGS. 4 and 5 show further variations. A lock 10*b* of FIGS. 4 and 5 has a lever-type or toggle-type handle 20*b*, limited in arc of movement and with a visual indication of whether the lock is in the locked or open position. The handle could be a longer lever, as for handicapped use. In FIG. 4 the access handle is in the horizontal position, exposing a flat area 26 which may be red in color, for example, indicating locked status. In FIG. 5 the handle has been shifted clockwise to the limit position, exposing a different area 28 under the handle's path, which may be green, for example, indicating unlocked status. The color areas 26 and 28 are revealed through a window in the handle device.

Figure 6:
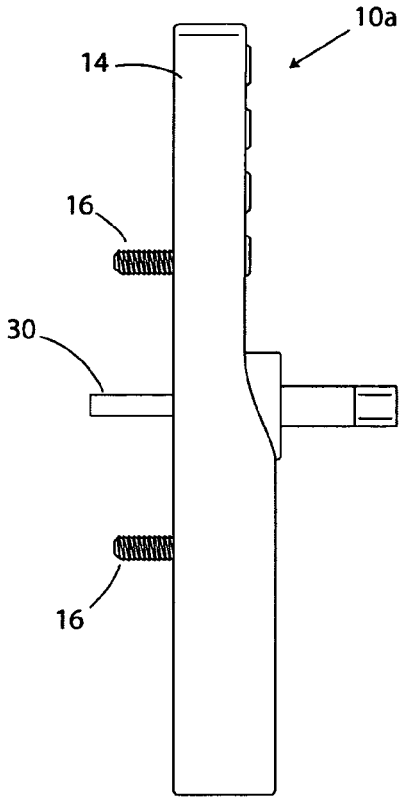
FIG. 6 is a side elevation view showing an electronic lock housing similar to that of FIGS. 1 and 2, with a driver extending back from a handle of the housing, to operate a latch mechanism at the back side of a locker door.

FIG. 6 shows a lock 10*a*, which may be similar to the lock of FIG. 3 or FIGS. 1 and 2, but having at its back side, extending from a midpoint between the studs 16 so as to pass through the center hole of a three-hole locker door prep pattern, a spindle or driver 30. The driver 30, which can be square, rectangular, triangular, splined or in other configurations, is engaged with a latch simply affixed to the driver 30 as in FIG. 1, or a latch mechanism of a suitable type such as shown in FIG. 7, the mechanism being secured to the back side of the door.

Figure 7:
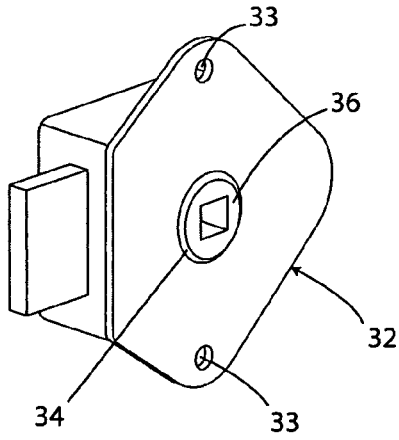
FIG. 7 is a perspective view showing a rear latch-operating mechanical unit which can be installed at the back side of a door having the electronic lock unit of FIG. 6. Such a latch unit is known in the industry as a built-in lock.

FIG. 7 shows, somewhat schematically, a mechanical latch or deadbolt unit 32, essentially of the type called in the industry a built-in lock for lockers. This can be either a deadbolt unit or a spring latch unit, a deadbolt being shown here. The unit 32 is made with the standard three-hole pattern and can be secured using the same studs 16 extending from the lock unit 10 or 10*a*, or with machine screws that are inserted from the back, first through holes 33 in the built-in unit 32 and then through the door panel and into threaded holes provided in the housing 14 of the lock 10 or 10*a*, as disclosed above. At the center position of the built-in deadbolt lock or latch unit 32, i.e. at the position of the large center hole of the three-hole pattern, is a rotation member 34 having a driver receiving hole 36 shaped according to the shape of the driver 30 extending back from electronic lock unit 10, 10*a*.

The built-in deadbolt or latch unit 32 is strictly mechanical, and is a substitute for a simple rotational latch such as shown at 12 in FIG. 1, for a situation in which a spring latch or a sliding deadbolt is appropriate.

Figure 8:
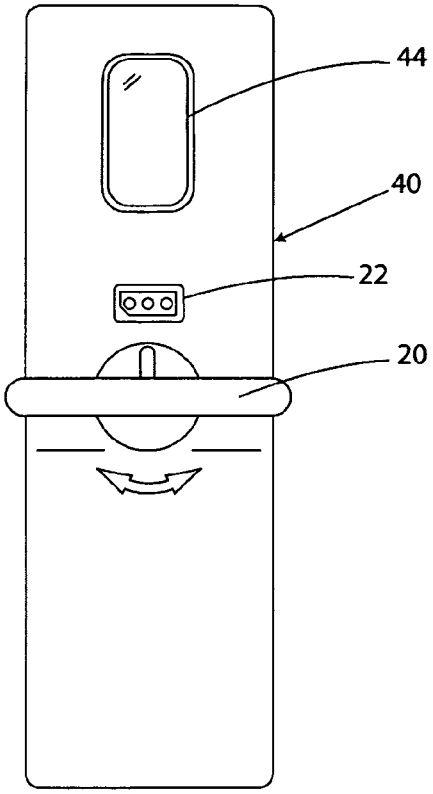
FIGS. 8 and 9 are front elevation views showing locker locks similar to FIGS. 1 and 2 but with an electronic code reader rather than a keypad.
Figure 9:
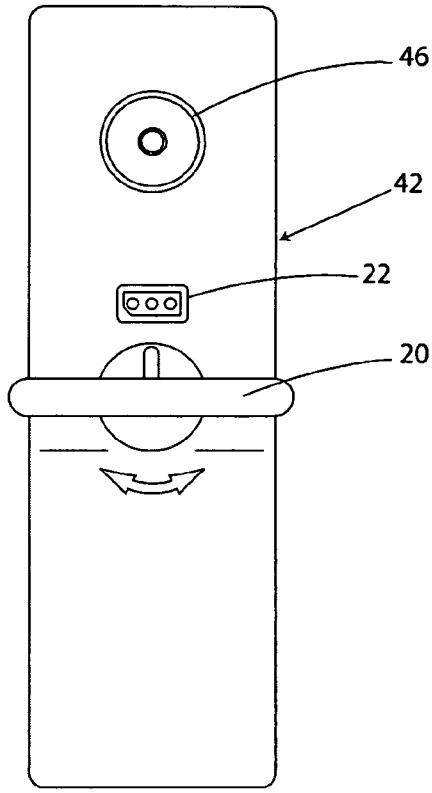

FIGS. 8 and 9 show another embodiment of a locker lock 40, 42 to fit the standard three-hole locker door pattern as in FIGS. 1 and 2. The lock is similar to the lock of those figures, except in not having a keypad. Instead, the locks 40 and 42 have an electronic code reader 44, 46. The code reader 46 on the lock of FIG. 9 is an iButton reader, which reads the code when an iButton "key" held by a user is touched to the reader 46. This is similar to the locker door lock described in U.S. Pat. No. 5,886,644 referenced above, but the lock of that patent had an electric retraction for retracting the bolt or latch, rather than the manual retraction of the locks shown in FIGS. 8 and 9, and in addition that locker door lock had a two-housing construction, with the locker door sandwiched between the inner and outer housings.

In FIG. 8 the reader 44 is an infrared or other wireless technology reader. Both locks 40 and 42 have a terminal 22, as described above, for accessing the lock by a manager or attendant, and for providing power to the lock if the lock's battery is low. Also as in the previously described locks, the back of the lock can have a driver to operate a mechanical latch or bolt unit such as shown in FIG. 7, or it can have a swivel latch directly attached as in FIG. 1.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. In combination with a locker for storage of a user's articles, the locker having a door and a movable latch positioned to secure the door when in latched position and to unlock the door when moved to an unlatched position, an electronic lock for controlling the latch, comprising:

a single electronics housing secured to the outside of the door, the housing containing electronics and having a keypad for entry of an access code which when properly entered will cause the electronics to permit access, a lock actuator or driver extending from a back side of the housing and through the locker door and connected to the movable latch, and the housing including a knob or handle for operating the driver manually to move the latch to the unlatched position when permitted by the electronics, and the housing being positioned on the front side of the door, the locker door having a three-hole lock receiving pattern with three holes in the door aligned vertically, including a middle hole comprising the opening through which the lock driver extends, and the upper and lower holes each receiving a fastener connecting the single housing to the front of the door.

2. The combination defined in claim 1, wherein the housing includes power jump contacts accessible from the outside of the door to supply power in the event of power failure.

3. The combination defined in claim 1, including an internal pin in the housing, engageable with the lock driver to put the lock in locked mode when the pin engages in a notch or recess in the lock driver, and the electronics including an electromagnetic retraction device operably connected to retract the pin for unlocking the lock, permitting the knob or handle to be turned to rotate the lock driver.

4. The combination defined in claim 1, including a miniature motor within the housing, the motor operating a blocking device normally engaged with the lock driver to block rotation of the lock driver and disengageable from the lock driver to permit rotation of the lock driver when the lock is in an unlocked mode, and the motor being controlled by the electronics.

5. The combination defined in claim 1, wherein the housing has dimensions of less than about 6 inches in height and about 2 inch in width, and no more than about ⅞ inch in depth.

6. The combination defined in claim 5, wherein the housing is less than about ⅝ inch in depth.

7. The combination defined in claim 1, wherein all electronics and a battery are contained in the housing, without any other housing or electronics to be positioned on the inner side of the door to which the lock is affixed.

8. The combination defined in claim 1, wherein the electronics housing comprises the sole housing and sole electronics of the lock.

9. The combination defined in claim 1, wherein the lock driver includes an internal rotatable member, the rotatable member having two notches, one for retaining the driver in locked configuration and the other for retaining the driver in unlocked configuration, and a movable blocking device controlled by the electronics and operable to engage in the one notch for a locked condition and the other notch when the lock and driver are rotated to an unlocked condition, such that when the locker and lock are to be used by a temporary user, when the lock is in the unlocked condition an access code is entered and the knob or handle can be manually turned to the locked position to lock the locker, in which position the blocking device engages in the one notch of the driver, and for unlocking the lock the access code is again entered to cause retraction of the blocking device to allow the knob to be returned to the unlocked position, in which the blocking device engages in the other notch.

10. The combination defined in claim 1, wherein the latch is secured directly to the lock driver.

11. The combination defined in claim 1, including a mechanical housing with the latch and including a rotary member with a receptacle for the lock driver to rotate the rotary member to retract the latch when the driver is permitted to be rotated by the knob or handle.

12. The combination defined in claim 1, wherein the housing includes exposed contacts and wherein the electronics are programmable by an external device contacting the exposed contacts.

13. The combination defined in claim 1, further including a battery compartment containing one or more batteries for operating the electronics, the battery compartment being at an accessible position on the housing when the housing is secured against the locker door.

14. The combination defined in claim 13, wherein the battery compartment includes an openable battery door which is locked in a closed position when the lock is in locked mode.

15. The combination defined in claim 14, wherein the housing includes accessible power jump contacts for supplying power in the event of battery failure.

16. The combination defined in claim 15, wherein the contacts include contacts for receiving electronically a master code to open the lock, at the same time power is applied.

17. The combination defined in claim 13, wherein the batteries in the battery compartment comprise a plurality of batteries not larger than two AAA batteries.

18. The combination defined in claim 13, wherein the batteries in the battery compartment comprise a plurality of coin cell batteries.

19. An electronic lock for a locker door, cabinet or drawer, comprising:

a compact housing containing electronics and having a keypad for a user's entry of a code which when properly entered will cause the electronics to permit access, the housing adapted for being positioned on a front side of a panel of a locker door or other openable panel to which the lock is to be affixed, a lock driver extending from a back side of the housing, adapted to engage with a locker latch device on the inside of the locker door, with a knob or handle on the housing for operating the lock manually to rotate the lock driver when permitted by the electronics, and the housing being configured to fit a contemporary locker door with a three-hole lock receiving pattern with three holes in the locker door aligned vertically, including a middle hole through which the lock driver can extend rearwardly from the housing, and such that fasteners are positioned to extend through upper and lower of the three holes to secure the housing to such a locker door.

20. The electronic lock of claim 19, wherein the housing includes power jump contacts accessible from the outside of the locker door to supply power in the event of power failure.

21. The electronic lock of claim 20, wherein the contacts include contacts for receiving electronically a master code to open the lock, at the same time power is applied.

22. The electronic lock of claim 19, wherein the knob or handle comprises a toggle lever on the front of the housing and having a limited arc of movement from a locked position swung fully in one direction to an unlocked position swung fully in an opposite direction, and including a visual indicator as to locked or unlocked status.

23. The electronic lock of claim 22, wherein the visual indicator status comprises two different patches of color to indicate status, a first color being exposed when the handle is moved to the locked position and a second color being exposed when the toggle lever is moved to the unlocked position.

24. The electronic lock of claim 19, further including a battery compartment containing one or more batteries for operating the electronics, the battery compartment being positioned on the housing to be accessible when the housing is secured against a locker door.

25. In combination with a locker for storage of a user's articles, the locker having a door and a movable latch positioned to secure the door when in latched position and to unlock the door when moved to an unlatched position, an electronic lock for controlling the latch, comprising:

a single electronics housing secured to the outside of the door, the housing containing electronics and having a terminal for entry of an access code which when properly entered will cause the electronics to permit access, a lock actuator or driver extending from a back side of the housing and through the locker door and connected to the movable latch, and the housing including a knob or handle for operating the driver manually to move the latch to the unlatched position when permitted by the electronics, and the housing being positioned on the front side of the door, the locker door having a three-hole lock receiving pattern with three holes in the door aligned vertically, including a middle hole comprising the opening through which the lock driver extends, and the upper and lower holes each receiving a fastener connecting the single housing to the front of the door. comprising:

a single electronics housing secured to the outside of the door, the housing containing electronics and having a terminal for entry of an access code which when properly entered will cause the electronics to permit access, a lock actuator or driver extending from a back side of the housing and through the locker door and connected to the movable latch, and the housing including a knob or handle for operating the driver manually to move the latch to the unlatched position when permitted by the electronics, and the housing being positioned on the front side of the door, the locker door having a three-hole lock receiving pattern with three holes in the door aligned vertically, including a middle hole comprising the opening through which the lock driver extends, and the upper and lower holes each receiving a fastener connecting the single housing to the front of the door.

26. The combination defined in claim 25, wherein the terminal for entry of an access code comprises a wireless technology reader.

27. The electronic lock of claim 24, wherein the battery compartment includes an openable battery door which is locked in a closed position when the lock is in locked mode.

28. The combination defined in claim 25, further including a battery compartment containing one or more batteries for operating the electronics, the battery compartment being at an accessible position on the housing when the housing is secured against the locker door.

* * * * *

UNITED STATES PATENT AND TRADEMARK OFFICE

CERTIFICATE OF CORRECTION

PATENT NO. : 8,161,781 B2
APPLICATION NO. : 12/214364
DATED : April 24, 2012
INVENTOR(S) : Asil T. Gokcebay It is certified that error appears in the above-identified patent and that said Letters Patent is hereby corrected as shown below:

Col. 7, line 27, delete the entire text beginning with "comprising:" to and ending with "... and having a", in line 29.

Col. 8, line 1, delete the entire text beginning with "terminal for entry of an access code..." to and ending with "housing to the front of the door.", in line 15.

Signed and Sealed this
Nineteenth Day of June, 2012

David J. Kappos

David J. Kappos
*Director of the United States Patent and Trademark Office*